US007583920B2

(12) United States Patent
Willemsens et al.

(10) Patent No.: US 7,583,920 B2
(45) Date of Patent: Sep. 1, 2009

(54) ELECTROSTATOGRAPHIC SINGLE-PASS MULTIPLE STATION PRINTER WITH IMPROVED COLOUR REGISTRATION

(75) Inventors: Werner Willemsens, Sint-Katelijne-Waver (BE); Erik Van Waverberg, Mortsel (BE); Herman Van De Straete, Deurne (BE); Romain Van Der Gucht, Lint (BE); Frank Deschuytere, Beveren (BE)

(73) Assignee: Punch Graphix International N.V., Lier (BE)

( * ) Notice: Subject to any disclaimer, the term of this patent is extended or adjusted under 35 U.S.C. 154(b) by 231 days.

(21) Appl. No.: 11/545,453

(22) Filed: Oct. 11, 2006

(65) Prior Publication Data

US 2007/0092309 A1 Apr. 26, 2007

(30) Foreign Application Priority Data

Oct. 11, 2005 (EP) ..... 05447228

(51) Int. Cl.
*G03G 15/01* (2006.01)

(52) U.S. Cl. ..... 399/301

(58) Field of Classification Search ..... 399/301
See application file for complete search history.

(56) References Cited

U.S. PATENT DOCUMENTS

| | | | | |
|---|---|---|---|---|
| 4,977,411 | A | 12/1990 | Pepe | |
| 5,499,093 | A | 3/1996 | Aerens et al. | |
| 5,828,937 | A * | 10/1998 | Aerens et al. | 399/301 |
| 6,370,354 | B1 * | 4/2002 | Chapman et al. | 399/394 |

* cited by examiner

*Primary Examiner*—Quana M Grainger
(74) *Attorney, Agent, or Firm*—Bacon & Thomas, PLLC

(57) ABSTRACT

The present invention provides improved electrostatographic single-pass multiple station printers as well as methods of operating the same being able to avoid displacement of different color images by effects of the toner coverage of the printed pages. To obtain this, a main encoder means (50) and a printing medium advancement measurement means (60*a*) are provided, the main encoder means (50) for producing a first signal (501) indicative of printing medium displacement and the printing medium advancement measurement means (60*a*) for providing a second signal (601) representative of printing medium advancement. The printing medium advancement measurement means (60*a*) is adapted to co-operate with the main encoder means (50) for automatic adjustment of said first signal (501) using said second signal (601).

18 Claims, 6 Drawing Sheets

ELECTROSTATOGRAPHIC SINGLE-PASS MULTIPLE STATION PRINTER WITH IMPROVED COLOUR REGISTRATION

TECHNICAL FIELD OF THE INVENTION

The present invention relates to methods and apparatus for an electrostatographic single-pass multiple station (for example multiple colour) printer for forming an image onto a printing medium, and more in particular to register control means and method for controlling the operation of each of the stations of such electrostatographic single-pass multiple station printer.

BACKGROUND OF THE INVENTION

Electrostatographic single-pass multiple station printers are known in the art, such as from U.S. Pat. No. 4,977,411.

U.S. Pat. No. 5,499,093 describes an electrostatographic single-pass multiple station printer, which comprises a number of consecutive single colour printing stations. Each single colour printing station is adapted to print a specific single colour image to a printing medium passing though the printer. All single colour images printed one over the other provide together the composite image being a multicolour image. In order to generate a multicolour image without colours being in offset one versus the other, it is understood that a perfect timing or synchronisation of the printing actions of the consecutive printing stations is necessary.

For obtaining such synchronisation, U.S. Pat. No. 5,499,093 discloses that an encoding means is used to generate a set of pulses, which pulses are indicative of the web displacement that has occurred. The encoding means is driven by one of the rotatable endless surface means onto which a toner image can be formed at one particular printing station. The transformation of the set of pulses into synchronised commands for the consecutive printing stations is performed by a register control means.

According to U.S. Pat. No. 5,499,093 the encoder means is preferably coupled to a printing station which is not located as the first, nor as the last printing station in the sequence, but to an intermediate printing station, preferably the central printing station in the sequence of consecutive printing stations. Such a choice of an intermediate printing station is preferred because in that case the web path between the drum carrying the encoder and the drum most remote therefrom is minimised thereby reducing any inaccuracies which may arise from unexpected stretching of the web and of variations induced by the eccentricity of the drums or the rollers defining the wrapping angle $\omega$, caused by e.g. machine vibrations. The high-frequency vibrations may be compensated or filtered with large accuracy by a filtering means being part of the register control means.

The register control means may possibly comprise manual adjustment means to compensate deviations of web displacement, measured after printing and analysing prints of calibration images.

SUMMARY OF THE INVENTION

It is an object of the present invention to provide improved electrostatographic single-pass multiple station printers for forming an image onto a printing medium, as well as methods of operating the same. It is further an object of the present invention to provide improved electrostatographic single-pass multiple station printers as well as methods of operating the same being able to avoid displacement of different colour images in general, and more specifically to avoid displacement of different colour images by effects of the toner coverage of the printed pages.

An aspect of the present invention is being able to automatically, i.e. without intervention of an operator, compensate for low frequency vibrations.

The above objectives are accomplished by an electrostatographic single-pass multiple station printer according to the present invention having the features as set out in the attached claims.

In a first aspect, the present invention provides an electrostatographic single-pass multiple station printer for forming an image onto a printing medium, which comprises:

(i) a plurality of toner image-printing electrostatographic stations comprising
  - (ia) rotatable endless surface means onto which a toner image can be formed;
  - (ib) means for forming an electrostatic toner image on each said surface means; and
  - (ic) means for transferring the formed toner image onto the printing medium;

(ii) means for conveying the printing medium in succession past said stations in synchronism with the peripheral speed of said rotatable endless surface means; and (iii) register control means for controlling the operation of each of said stations in timed relationship thereby to obtain correct registering of the distinct toner images on the printing medium, wherein said register control means comprises
  - (iiia) a main encoder means for producing a first signal indicative of printing medium displacement, and
  - (iiib) delay means for initiating the operation of subsequent image-printing stations after a predetermined printing medium displacement, as measured by the main encoder means, has occurred.

In a printer according to this first aspect, the register control means comprises a further printing medium advancement measurement means for providing a second signal representative of printing medium advancement, said printing medium advancement measurement means being adapted to co-operate with said main encoder means for automatic adjustment of said first signal using said second signal. The adjusted first signal can then be provided to the delay means. The delay means may use this adjusted first signal as being representative of printing medium advancement, in real-time, and use this adjusted first signal for initiating a control signal 911 for each of the printing stations controlled by the register control means 90.

In embodiments of the present invention, the printing medium advancement measurement means may be an optical printing medium advancement measurement means.

In other embodiments of the present invention, the printing medium advancement measurement means may be a mechanical printing medium advancement measurement means. In this case, the main encoder means may be mechanically coupled to a first rotatable endless surface means onto which a toner image can be formed.

The printing medium advancement measurement means may comprise a second encoder means for producing the second signal indicative of printing medium displacement. The printing medium advancement measurement means may be coupled to said main encoder means by means of a comparator, for obtaining the difference between said second signal and said first signal indicative of printing medium displacement, said difference being used to automatically adjustment said first signal indicative of printing medium displacement. In a first embodiment of the present invention, the second encoder means may be mechanically coupled to a second of said rotatable endless surface means onto which a toner image can be formed. The second rotatable endless surface means preferably is different from the first rotatable endless surface means. Said second of said rotatable endless surface means onto which a toner image can be formed may be the rotatable endless surface means of the toner image-printing electrostatographic station first past by the printing medium. In one other embodiment of the present invention, the second encoder is preferentially mechanically coupled to a high precision roller in contact with the printing medium, preferably upstream the electrostatographic station first past by the printing medium.

The main encoder means may be located downstream of said printing medium advancement measurement means.

The main encoder means may be mechanically coupled to the rotatable endless surface means onto which a toner image can be formed of an intermediately positioned toner image-printing electrostatographic station.

The printing medium advancement measurement means may include measurement means for measuring any of longitudinal printing medium displacement, absolute position of the printing medium, printing medium velocity, printing medium acceleration or a combination of any of these.

In a second aspect, the present invention provides a method of operating an electrostatographic single-pass multiple station printer for forming an image onto a printing medium, the printer comprising:

(i) a plurality of toner image-printing electrostatographic stations comprising
  (ia) rotatable endless surface means onto which a toner image can be formed;
  (ib) means for forming an electrostatic toner image on each said surface means; and
  (ic) means for transferring the formed toner image onto the printing medium;
(ii) means for conveying the printing medium in succession past said stations in synchronism with the peripheral speed of said rotatable endless surface means. The method comprises controlling the operation of each of said stations in timed relationship thereby to obtain correct registering of the distinct toner images on the printing medium, the controlling comprising:
  deriving a first signal indicative of printing medium displacement, and
  delaying the operation of subsequent image-printing stations after a predetermined printing medium displacement,
  deriving a second signal representative of the printing medium advancement from a measurement performed on said printing medium, and
  adjusting said first signal using said second signal.

The adjusted first signal may thus be used to delay the operation of subsequent image printing stations, more particular to delay the operation of subsequent image printing stations in real-time during displacement of this printing medium.

The printing medium advancement may include any of longitudinal printing medium displacement, absolute position of the printing medium, printing medium velocity, printing medium acceleration or a combination of any of these.

It is an advantage of embodiments of the present invention to provide accurate signals for the printing medium position as the printing medium travels through the printer, which signals are not or only to a limited extent, e.g. less than in prior-art printers, subject to systematic inaccuracies induced by the toner coverage of the printed pages. It is further an advantage of embodiments of the present invention to be able to provide accurate signals to finishing apparatus such as sheet cutting apparatus, die cutting apparatus for labels, folding apparatus or other apparatus, which benefit from accurate information on the printing medium displacement.

Particular and preferred aspects of the invention are set out in the accompanying independent and dependent claims. Features from the dependent claims may be combined with features of the independent claims and with features of other dependent claims as appropriate and not merely as explicitly set out in the claims.

It is understood that electrostatographic single-pass multiple station printers will usually use dry-particulate toner, however the invention is equally applicable where the toner particles are present as a dispersion in a liquid carrier medium or in a gas medium in the form of an aerosol.

The electrostatographic single-pass multiple station printers may especially be a colour printer comprising image printing stations-for each of yellow, magenta, cyan and black toner images. Such printing stations being provided to provide images only on one side of the printing medium in a single side printer, or alternatively, of each of such stations one is present to print on each of the sides of the printing medium in a double side printer or so-called "duplex printer".

According to the present invention, the printing medium may be a transfer printing medium, e.g. a temporary support such as a tensioned endless belt, onto which the various colour images are provided by passing the consecutive printing stations. It is understood that in such embodiments, the single pass multiple station printer of the present invention comprises a means for transferring the image formed on the printing medium onto a final printing medium such as a web, e.g. a paper web. The final printing medium may be provided by unwinding the final printing medium from a roll, or as individual parts, e.g. sheets of web. As an alternative, the printing medium may itself be the final printing medium, e.g. a web such as a paper web, onto which the image is to be provided. In such embodiment, the printer may further comprise a roll stand for unwinding a roll of web to be printed in the printer, and a web cutter for cutting the printed web into sheets.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DESCRIPTION OF ILLUSTRATIVE EMBODIMENTS

Figure 1:
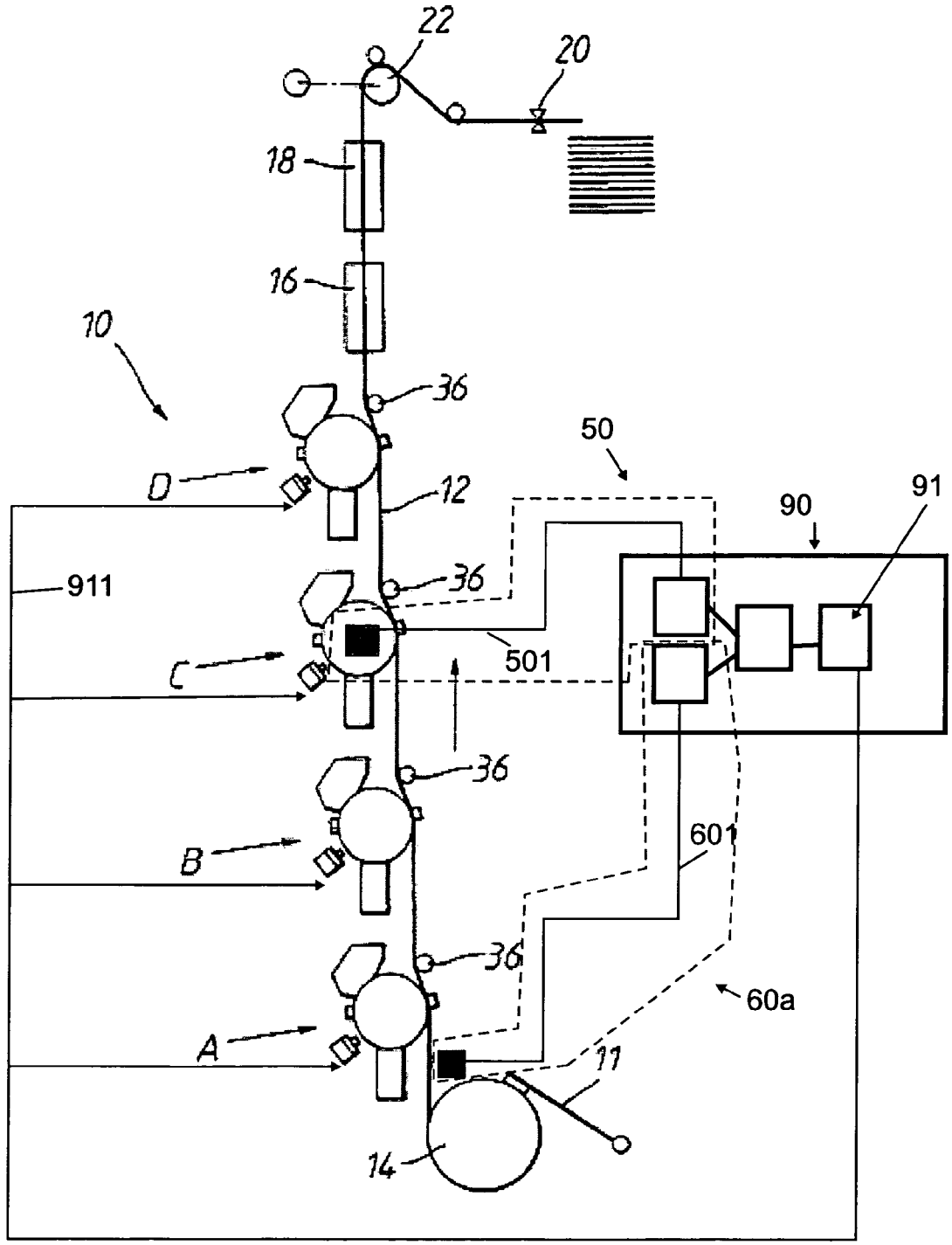
FIG. 1 is a schematic representation of a side (planar) view of the apparatus according to a first embodiment of the present invention, showing a single-side electrostatographic single-pass multiple station printer.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "coupled", also used in the claims, should not be interpreted as being restricted to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

The term 'printing station' used hereafter refers to a toner image-printing electrostatographic station.

It is understood that electrostatographic single-pass multiple station printers will usually use dry-particulate toner, however the invention is equally applicable where the toner particles are present as a dispersion in a liquid carrier medium or in a gas medium in the form of an aerosol.

The electrostatographic single-pass multiple station printers described with reference to the present invention may especially be a colour printer comprising image printing stations for each of a sequence of 3 or more primary colours such as yellow, magenta, cyan as well as other printing stations, e.g. for black toner images or for spot colour toner images. Such printing stations being provided to provide images only on one side of the printing medium in a single side printer, or alternatively, of each of such stations one is present to print on each of the sides of the printing medium in a double side printer.

FIG. 1 shows a schematic representation of a side view of a single-side electrostatographic single-pass multiple station printer 10. The printer 10 illustrated comprises 4 consecutive printing stations labelled A, B, C and D, which are arranged to e.g. print yellow, magenta, cyan and black respectively. It is to be understood that the configuration illustrated is not intended to be limiting for the present invention, and that a configuration with more or less printing stations is included in the present invention as well. The printing stations A, B, C and D are arranged in a substantially vertical configuration, but it is to be understood that a substantially horizontal configuration or any other configuration might apply. The printing medium 12 is unwound from a supply roller 14, and in the example illustrated is a printing web, such as e.g. a paper web. The printing medium is pulled through the printer 10 by means of a motor driven drive roller 22. Tension is provided to the printing medium 12 by a brake 11 located at the supply roller 14. The printing medium 12 is conveyed in upward direction past the printing stations A, B, C, D in turn. The moving printing medium 12 is in face-to-face contact with the surfaces 26 of the drums 24 (see also FIG. 3) of the printing stations A, B, C and D, preferably over an angle $\alpha$ of about 15° of the circumference of the drums 24, which angle is determined by guiding rollers 36. After having passed the last printing station D in the row, the printing medium 12 is passed trough an image fixing station 16 and possibly a cooling zone 18. The printer may furthermore optionally comprise a cutting device 20.

The single-side electrostatographic single-pass multiple station printer 10 further comprises a main encoder means 50, being coupled to an intermediate printing station, being in the embodiment illustrated in FIG. 1 either printing station B or C. As shown in FIG. 1, the printing station B of the single side electrostatographic single-pass multiple station printer 10 comprises the main encoder means 50 as is described in more detail with regard to FIG. 4. The main encoder means 50 generates a set of pulses 501, which set of pulses 501 is relative to the printing medium displacement, e.g. by its frequency.

The main encoder means 50 may provide a first set of pulses which set of pulses is indicative for the printing medium displacement. This means that during the time lapse between consecutive pulses, the printing medium is displaced over a given length $\rho$. This may be achieved by e.g. mechanically coupling a rotatable encoder disc to one of the rotatable endless surface means onto which a toner image can be formed at a given printing station. The encoder disk carries a number of marks, which may be detected by a sensing means. This sensing means may be stimulated optically, mechanically or magnetically. Measures are taken to prevent slip between the printing medium and the rotatable endless surface means, and between the encoder disc and the rotatable endless surface means. Therefore, as the encoder disc has a substantially constant radius R and rotates around its central axis, the factor in the linear relationship between angle of rotation α and printing medium displacement caused by this rotation is R. The pulses provided by this sensing means, and in particular the frequency of these pulses may be multiplied by a real number by a multiplier means, providing the set of pulses indicative for the printing medium displacement.

As preferred, in case the main encoder means 50 is coupled to an intermediate printing station, preferably the central printing station, in the row of consecutive printing stations, most of the high-frequency vibrations will be reflected in the pulses and pulses' frequency and can be compensated or filtered with most accuracy in order to provide an accurate timing of the different printing stations using simple electronic filtering circuits.

The term 'intermediate printing station' is to be understood as a printing station, which has at least one other station located upstream and one other printing station located downstream in the printing medium moving direction. The term 'central printing station' is to be understood as the printing station, which has an equal number of other printing stations located upstream and downstream in the printing medium moving direction in case of an odd number of printing stations. In case of an even number of printing stations, the term 'central printing station' is to be understood as the printing station whereby preferably the number of printing stations located upstream along the printing medium moving direction is 1 more compared to the number downstream along the printing medium moving direction.

It has been noticed by the Applicant, that, especially in case of high coverage printing output, colour deviations may occur despite a high-frequency compensation being present. Such deviations cannot immediately be compensated by the means present in the electrostatographic single-pass multiple station printers as presently known. For example, in case there is a significant amount of toner present on the printing medium 12 when the printing medium passes the encoder disc 51 of the main encoder means 50 or the device to which the encoder disc 51 is coupled mechanically, which is especially the case when higher coverage printing output is required, the relation between angular rotation α of the encoder disc 51, and the actual printing medium displacement is no longer R, but is equal to a slightly higher apparent radius R'. The Applicant has found surprisingly that this small difference between R and R', being the toner thickness present on the printing medium 12 when passing the encoder disc 51 may be sufficient to create a colour offset in the consecutive printing stations.

The single-side electrostatographic single-pass multiple station printer 10 according to an aspect of the present invention further comprises a printing medium advancement measurement means 60*a* which may be located in printing medium moving direction before the main encoder means 50, and in the example of FIG. 1 is located at the side of the printing medium 12 which is not to be printed.

The term 'printing medium advancement measurement means' is to be understood as a means for measuring the printing medium's longitudinal displacement, absolute position, velocity, acceleration or any combination of these.

The printing medium advancement measurement means 60*a* may e.g. be any presently known appropriate longitudinal printing medium displacement measurement means, absolute position measurement means, printing medium velocity measurement means, or printing medium acceleration measurement means, or a combination of any of these, such as e.g. an optical or a mechanical measurement means. The printing medium advancement measurement means 60*a* may make contact with the printing medium 12 or may be contactless.

In order to have a good effect of the use of a printing medium advancement measurement means 60*a*, 60*b*, the printing medium advancement measurement means is preferably a longitudinal printing medium displacement or a means for determining a value related to printing medium advancement such as an average advancement measuring means or or a means for determining a time differential of the advancement such as a printing medium velocity measurement means. More preferred a non-contact measurement means, in order to avoid an influence of any fluctuation in printing medium thickness and/or presence of toner or of frictional variations on the advancement of the printing medium caused by a contact measuring means. In case of mechanical printing medium advancement measurement means, contacting the printing medium, the point of contact between an element of the measurement means and the printing medium is preferably not disturbed by presence of toner. As an example, in case of a single-side electrostatographic single-pass multiple station printer, the contact between printing medium and element of the printing medium advancement measurement means may be provided at the non-printed side.

In case of a printing medium velocity measurement means, this means may be a tachometer (not represented in the drawings) comprising a roller in rolling slipless contact with the printing medium 12. The roller axis is coupled to a DC motor for generating an analog output signal (voltage), which is proportional to the speed of the printing medium 12.

In case of a longitudinal printing medium displacement measurement means, this means to track a longitudinal printing medium displacement typically comprise both mechanical means and optical or magnetic means to accurately account for the synchronous slipless motion of a very precisely machined contacting roller. This means to track a longitudinal printing medium displacement can also directly measure marks or perforations on the printing medium 12 or the advancement of random auto-correlated "texture patterns" on the printing medium 12.

A printing medium advancement measurement means 60*a* carrying out a measurement by contacting the printing medium 12 at locations where no toner is present is preferred. A suitable location in case of single-side printing is to locate the measurement means 60*a* at a non printed side of the printing medium 12. As alternative embodiments (not shown in the drawings), the printing medium advancement measurement means 60*a* may e.g. be located between printing station D and image fixing station 16, i.e. after all printing stations A, B, C, D have been passed, at the non printed side of the printing medium 12, or before the first printing station A at the side of the printing medium 12 which is or is not to be printed.

Providing a location before or at the position of the first printing station A is preferred. A specific drum may be provided that can be machined to high precision and that lasts the life of the machine.

The printing medium advancement measurement means 60*a* generates a signal 601, which signal may e.g. be related to and representative for the printing medium displacement or instantaneous velocity at the printing medium advancement measurement means 60*a*.

By coupling back this printing medium advancement data signal 601 to printing medium displacement data signals 501 obtained from the main encoder means 50, an adjustment may be made based on the relative drift of the set of pulses of the main encoder means 50 and the signal of the printing medium advancement measurement means 60*a*. As will be explained in more detail further, the delay means 91 of the register control means 90 can generate control signals 911 for the different printing stations. The relative drift as resulting from the difference between the actual printing medium advancement determined by the printing medium advancement measurement means 60*a* and the printing medium displacement determined by the main encoder means 50 is thus taken into account. Or more in general, it was found that low frequency vibrations or disturbances may be filtered from the pulse and pulse frequency by taking into account the difference between the actual printing medium advancement, e.g. the actual longitudinal printing medium displacement determined by the printing medium advancement measurement means 60*a* and the longitudinal printing medium displacement determined by the main encoder means 50. The effect that the higher frequency vibrations, which cause slight variations in the pulse frequency, may be filtered out from the set of pulses as already known in the art, is still applicable.

In case the printing medium advancement measurement means 60*a* is a longitudinal printing medium displacement or velocity measurement means, the relative drift of the printing medium displacement data of the two measurement means 50, 60*a* can be interpreted as resulting from the time integrated velocity estimations derived from the longitudinal printing medium displacement or velocity measurement means 60*a*, and the time integrated velocity estimations derived from the longitudinal printing medium displacement data determined by the main encoder means 50. The difference in velocity estimation as measured by the two measurement means 50, 60*a* may be due to the thickness of toner deposited onto the printing medium 12. This changes the effective radius of a roller or rotatable endless surface means used for velocity determination and/or longitudinal printing medium displacement determination, and it has been found surprisingly by the inventor that this change in effective radius is non-negligible.

As will be described hereinafter as a preferred embodiment of the present invention, in case the printing medium advancement measurement means is a second encoder means producing a second set of pulses indicative for printing medium displacement, and being coupled to a rotatable endless surface means onto which a toner image can be formed at a particular printing station, the printing station to which this second encoder means is mechanically coupled is preferably the first printing station A which is met by the printing medium 12 when passing through the multiple station printer.

Best results using the invention are obtained when the main encoder means 50 is located downstream the additional printing medium advancement measurement means 60*a*, this is when the printing medium 12 first passes the additional printing medium advancement measurement means 60*a* and then the main encoder means 50, while passing through the multiple station printer 10.

Figure 2:
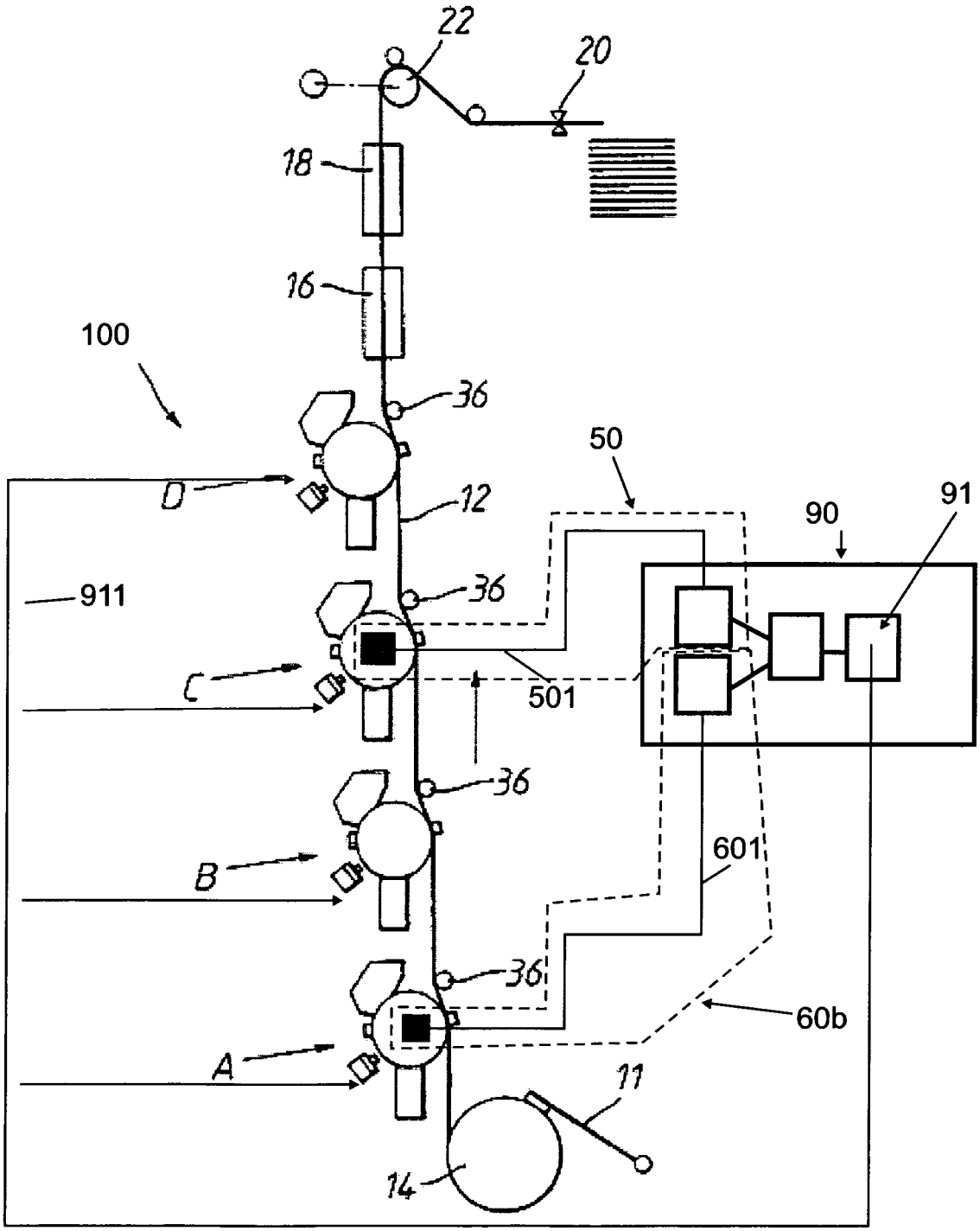
FIG. 2 is a schematic representation of a side (planar) view of the apparatus according to a second embodiment of the present invention, showing an alternative single side electrostatographic single-pass multiple station printer.

FIG. 2 schematically shows a side (planar) view of an apparatus of the present invention showing a single side electrostatographic single-pass multiple station printer 100. The printer 100 is identical to the printer 10 as shown in FIG. 1 and corresponding numerical references refer to identical means, except from the printing medium advancement measurement means 60*a*, e.g. longitudinal printing medium displacement or velocity measurement device, which is now provided as a printing medium advancement measurement means 60*b* comprising a second encoder means, being coupled to the printing station A. The printing medium advancement measurement means 60*b* generates a signal 601 which set of pulses 601 is relative to the printing medium displacement at the printing station A.

Figure 3:
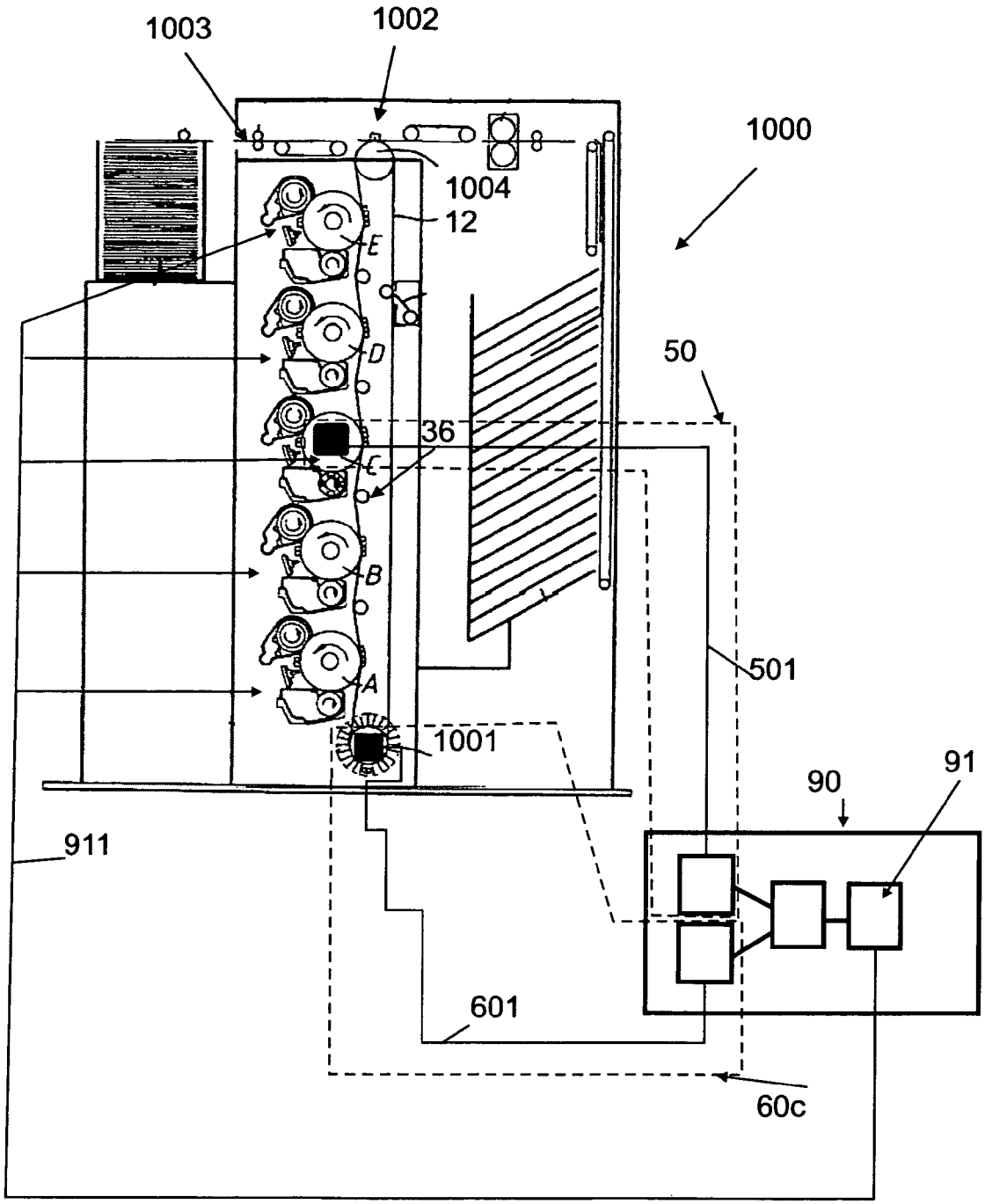
FIG. 3 is a schematic representation of a side (planar) view of the apparatus according to a third embodiment of the present invention, showing an alternative single side electrostatographic single-pass multiple station printer.

FIG. 3 shows a schematic representation of a side (planar) view of the apparatus 1000 according to a third embodiment of the present invention, showing an alternative single side electrostatographic single-pass multiple station printer. The printing medium used in this embodiment is a transfer printing medium, e.g. a temporary support such as a tensioned endless belt, onto which the various colour images are provided by passing the consecutive printing stations. The printer 1000 comprises five consecutive printing stations A, B, C, D and E. The printer 1000 is in some aspects similar to the printer 100 as shown in FIG. 2 and corresponding numerical references refer to identical means, except from the printing medium advancement measurement means 60*b*, e.g. longitudinal printing medium displacement or velocity measurement device, which is now provided as a printing medium advancement measurement means 60*c* comprising a second encoder means, being coupled to a reverse roll 1001. The printing medium 12 is a transfer printing medium implemented as an endless belt, which is tensioned by means of at least two reverse rolls 1001 and 1004. The printing medium advancement measurement means 60*c* generates however a similar signal 601 as in the embodiment of FIG. 2, which signal 601, preferably a set of pulses, is relative to the printing medium displacement at the reverse roll 1001. The printer 1000 further comprises a means 1002 for transferring the colour image present on the printing medium 12 onto a final printing medium 1003, e.g. being a paper sheet.

Figure 4:
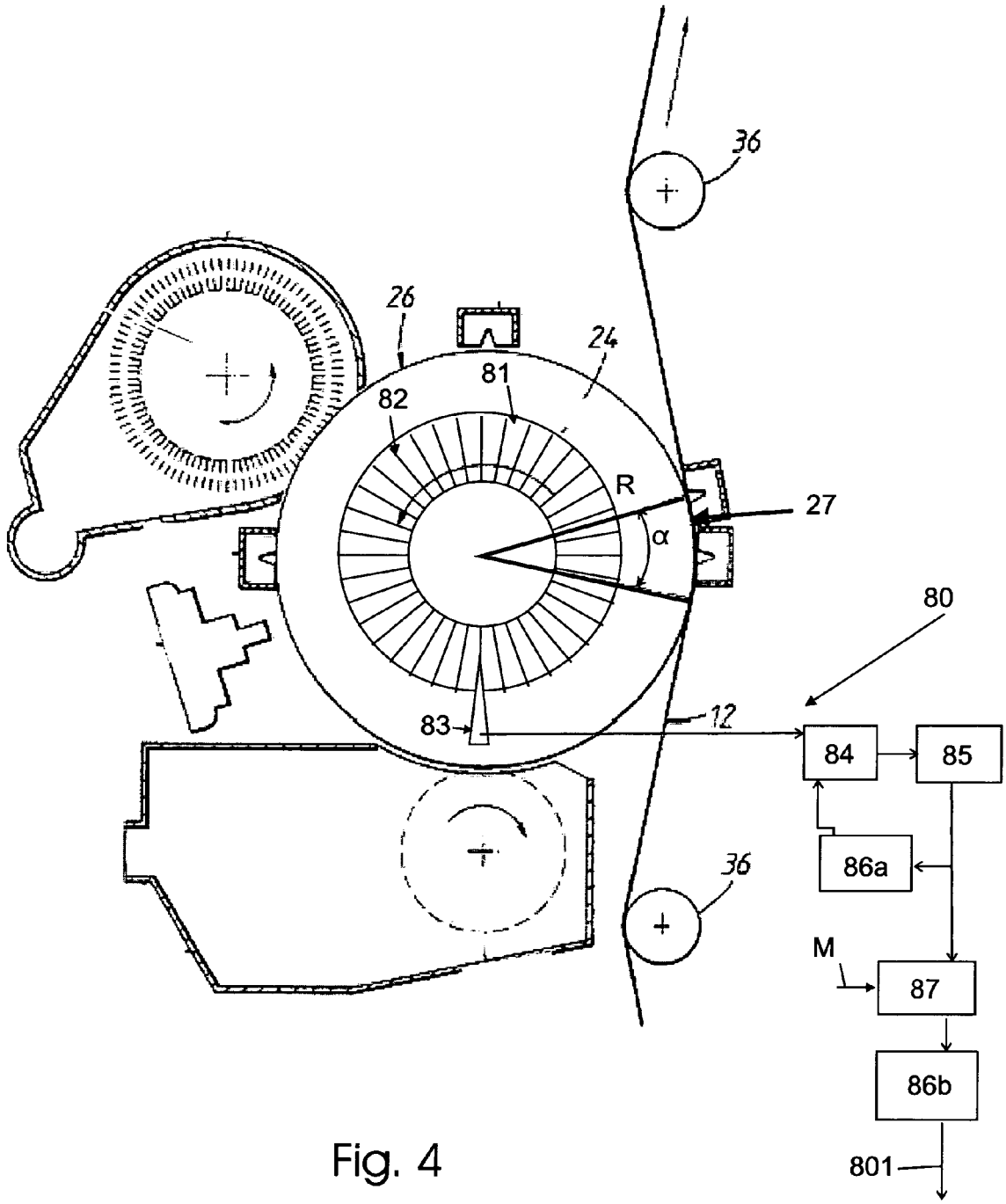
FIG. 4 is a schematic representation of a side (planar) view of a printer station being part of the printer as illustrated in FIG. 2, comprising an encoder disc and a sensor means.

To explain the working of the encoder means, either being the main encoder means 50 at an intermediate printing station C or the second encoder means of the printing medium advancement measurement means 60*b* of the embodiment of FIG. 2, FIG. 4 shows a printing station to which an encoder means 80 is coupled. An encoder disc 81 is coupled to the shaft of a rotatable endless surface means onto which a toner image can be formed, being the cylindrical drum 24 having a photoconductive outer surface 26 and having a radius R. While the printing medium 12 passes the printing station provided with the encoder means 80, the drum 24 is rotated over a given angle $\alpha$. This rotation of the drum 24 causes the encoder disc 81 coupled to it to rotate over the angle $\alpha$ as well. During this rotation, a number of marks 82 will pass an encoder sensor 83, each mark 82 passing the sensor 83 causing a pulse signal to be generated. Between two pulses, it can be calculated that a paper length being $\alpha\times(R+T+W/2)$ has passed, wherein T is the toner thickness being present at the contact zone 27 and W/2 is the distance from the paper surface oriented towards the drum 24 to the neutral line of the paper sheet, assumed to be located at half the thickness W of the paper.

A very accurate digital clock generator 86*a* is provided, capable of producing an output clock frequency that is proportional to a digital input value (called direct digital synthesis). This output frequency is compared to the set of pulses from the encoder sensor 83 by means of a comparator 84. Due to the digital nature of the signals, a very accurate phase comparison between both signals can be made. Using the output of comparator 84, a loop filter 85 then computes a new value for the input signal of digital clock generator 86*a*, such that the output of clock generator 86*a* tracks the encoder input very closely. This setup is well known as a digital PLL.

Now, by multiplying the input value of digital clock generator 86*a* by a multiplication constant M using a multiplier 87, and feeding the multiplied value to a second identical digital clock generator 86*b*, a set of pulses 801 is generated which proportionally tracks the encoder input closely, but runs at a much higher frequency. The multiplication constant M does not need to be an integer, but can be any real value, with an accuracy limited only by the resolution of the digital hardware.

A benefit of this setup is that the counters inside the digital clock generators actually present a very accurate measure of the position of the encoder disc 81, and hence of the paper.

The time period between each pulse of the pulsed signal 801 after the multiplier 87 now represents a paper displacement of $(\alpha\times(R+T+W/2))/M$. Due to vibrations in the printer, high-frequency vibrations may occur in this pulsed signal, which may be filtered out by means of the loop filter 85. The output of the encoder means 80 is a set of pulses 801, which is indicative of the printing medium displacement.

It is understood that for the embodiment of FIG. 3, the encoder means 80 of FIG. 4 is to be understood as being coupled to the shaft of the reverse roll 1001 instead as to the shaft of the rotatable endless surface means onto which a toner image can be formed. The set of pulses 601, which is indicative of the printing medium displacement, is however generated in an identical way, and comprises in the same way information about the printing medium displacement. Turning now back to FIGS. 1, 2 and 3, the main encoder means 50, if implemented as the encoder means 80 illustrated in FIG. 4, provides a set of pulses 501, of which the time lapse between two pulses represents a printing medium displacement of $(\alpha\times(R+T+W/2))/M$. In this formula, the toner thickness T may vary over time in view of differences in printing being carried out at the first printing station A, causing low-frequency vibrations or variations. Thus the printing medium displacement at printing station C is no longer uniformly related to the pulse interval.

However, according to the present invention, a second printing medium advancement measurement means 60*a*, 60*b* is used, be it an optical or mechanical means, to measure e.g. the printing medium velocity or displacement per time unit. The output signal 601 of such printing medium advancement measurement means 60*a*, 60*b* is now coupled to the main encoder means 50, in order to automatically adjust the set of pulses 501 being indicative of printing medium displacement.

The adjusted set of pulses, being indicative of printing medium displacement during the ongoing printing operation, i.e. in real-time, is provided to a delay means 91, this delay means 91, main encoder means 50 and printing medium advancement measurement means 60*a*, 60*b* or 60*c* being part of a register control means 90, generating control signals 911 being provided to the different printing stations A, B, C and D (as indicated with arrows 911 in FIG. 1, FIG. 2 and FIG. 3). The delay means 91 uses the real-time adjusted set of pulses as a measure indicative for the printing medium displacement, from which the delay means 91 initiates a control signal 911 for each of the printing stations controlled by the register control means 90.

The accurate signals for the printing medium position as the printing medium travels through the printer, i.e. the adjusted set of pulses, are not or only to a limited extent, subject to systematic inaccuracies induced by the toner coverage and/or image information of the printed pages. This presence of accurate signals for the printing medium position as the printing medium travels through the printer also allows the register control means 90 to provide accurate signals to finishing apparatus such as sheet cutting apparatus, die cutting apparatus for labels, folding apparatus or other apparatus, which benefit from accurate information on the printing medium displacement.

It is to be understood that the register control means 90 may further comprise additional means, not described in detail here but within the reach of a person skilled in the art, such as encoder correction means for making corrections for faults caused by incorrect reading of encoder discs, either when such disc is part of the main encoder means of in case the velocity measurement means comprises such encoder disc.

Figure 5:
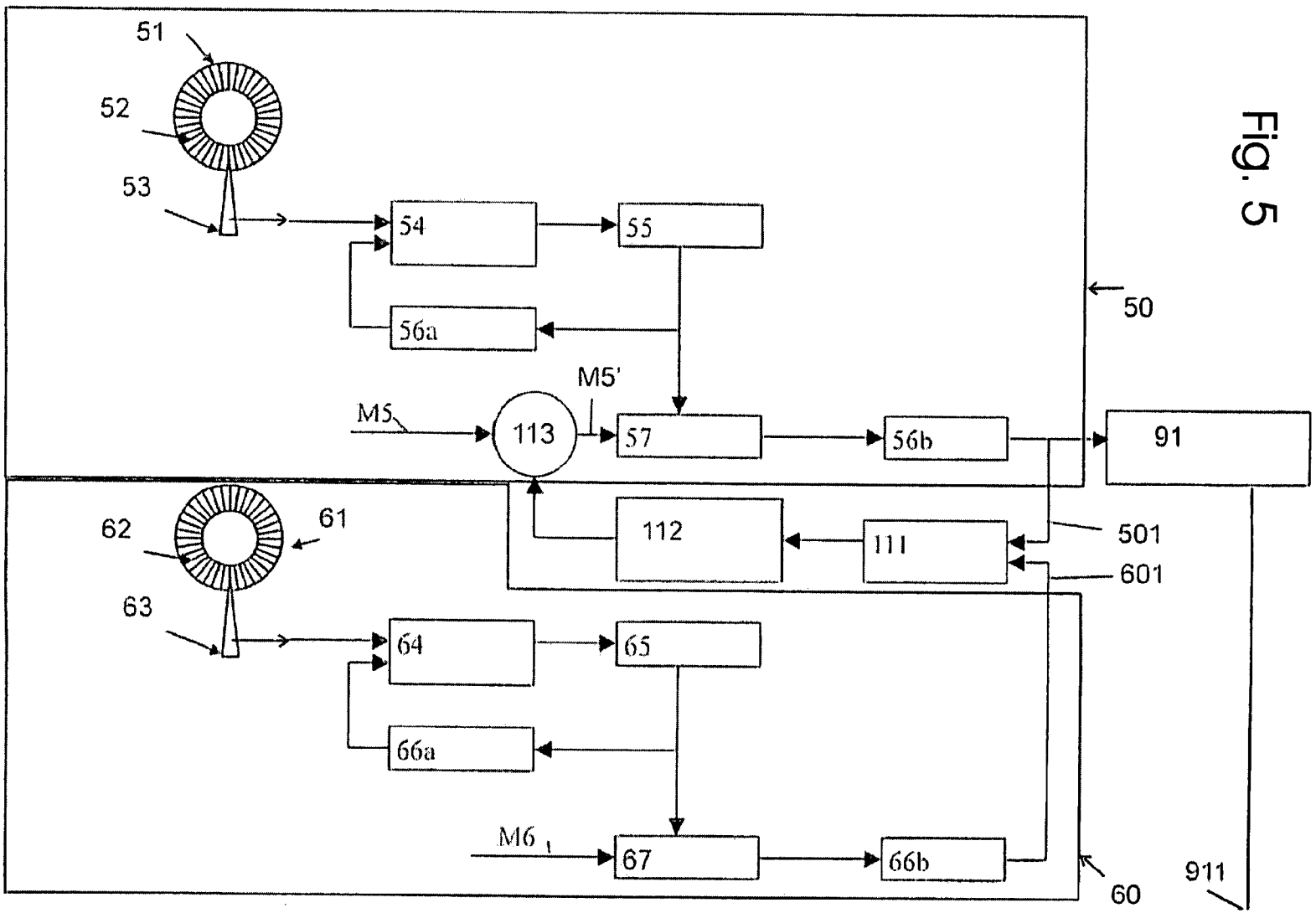
FIG. 5 shows is a block diagram schematically illustrating the coupling of the main encoder means and a printing medium advancement measurement means under the form of a longitudinal printing medium displacement measurement means, that is based on an additional encoder as in the embodiment of the present invention as shown in FIG. 2 or FIG. 3.

Turning to the preferred embodiments as shown in FIG. 2 and FIG. 3, the coupling of the main encoder means 50 and printing medium advancement measurement means 60*b* or 60*c* is schematically shown in FIG. 5.

The printing medium advancement measurement means 60*b* or 60*c*, implemented as a second encoder means 60, comprises an encoder disc 61 with marks 62 and an encoder sensor 63, providing a pulsed signal to a comparator 64. Comparator 64 compares the pulsed signal with the output signal of a digital clock generator 66*a*. Using the output of comparator 64, the loop filter 65 then computes a new value for the input signal of digital clock generator 66*a*, such that the output of clock generator 66*a* tracks the set of pulses of the second encoder input very closely. The new value for the input signal of digital clock generator 66*a* as provided by the loop filter 65 is multiplied by multiplier 67 by using a multiplication factor M6. This value is now used as input signal of a second identical digital clock generator 66*b*, generating a set of pulses 601, which proportionally tracks the second encoder input closely.

The main encoder means 50 comprises an encoder disc 51 with marks 52 and an encoder sensor 53, providing a pulsed signal to a comparator 54. Comparator 54 compares the pulsed signal with the output signal of a digital clock generator 56*a*. Using the output of comparator 54, the loop filter 55 then computes a new value for the input signal of digital clock generator 56*a*, such that the output of clock generator 56*a* tracks the set of pulses of the encoder input very closely. The new value for the input signal of digital clock generator 56*a* as provided by the loop filter 55 is multiplied by multiplier 57 by using a multiplication factor M5. This value is now used as input signal of a second identical digital clock generator 56*b*, generating a set of pulses 501, which proportionally tracks the main encoder input closely.

The set of pulses 601 are coupled to the main encoder means 50 by a comparator 111 comparing the signals 501 and 601 from the main encoder 50 and from the second encoder means 60 respectively. By comparing the phase of the set of pulses 501 and 601 from the main encoder 50 and from the second encoder means 60 respectively, a comparison of the position of both encoders is made. Hence, low frequency variations or 'low frequency drift' of the imaging drum diameter may be distinguished from high frequency vibrations by this comparison. Compensating means 112, providing a value for the modification to be applied to the multiplication factor M5, in order to compensate this low frequency drift. The multiplication factor M5 is then modified to M5' by adding or subtracting A % of the value of M5, by means of an adder 113. Preferably the difference between M5 and M5' is not more than 0.1% in both directions.

The adjusted set of pulses is provided to the delay means 91 of the register control means 90, providing control signals 911 being provided to the different printing stations A, B, C and D.

In general, the adjusted set of pulses is provided to the delay means 91 for providing control signals 911, which on their turn are provided to the different printing stations coupled to the delay means. The printing action of each of the printing stations may be triggered by such a control signal 911. The control signals 911 are preferably used to control the line exposure of line array exposure based printing stations, such as LED-based printing stations such as disclosed in e.g. U.S. Pat. No. 5,499,093 and EP453612A1, Vertical Cavity Surface Emitting Lasers such as disclosed in U.S. Pat. No. 5,940,113, which Lasers are capable of imaging the exposure sensitive medium one line at the time, or exposures based on two-dimensional array based exposure systems that can be based on digital micromirror or liquid crystal 2D-light modulators that are capable of exposing the sensitive media in an overlay scheme as detailed in e.g. U.S. Pat. No. 5,461,411.

In case of 1D or line array exposures, an image memory is organised as a two-dimensional array of pixels, where for each line (or row) a stream of pixel values are fed to the writing heads of each of the printing stations which may result in a line-wise exposure of the photoconductive drum surface. After a given number of pulses of the adjusted set of pulses, a next line of pixels is fed to the writing heads, of each of the printing stations. In this way the registration of the different images is not only accurate at the beginning of the image, but it also stays accurate within the image.

The control signal 911 may directly, i.e. in real time, determine and start actual line exposure events of the printing station.

Figure 6:
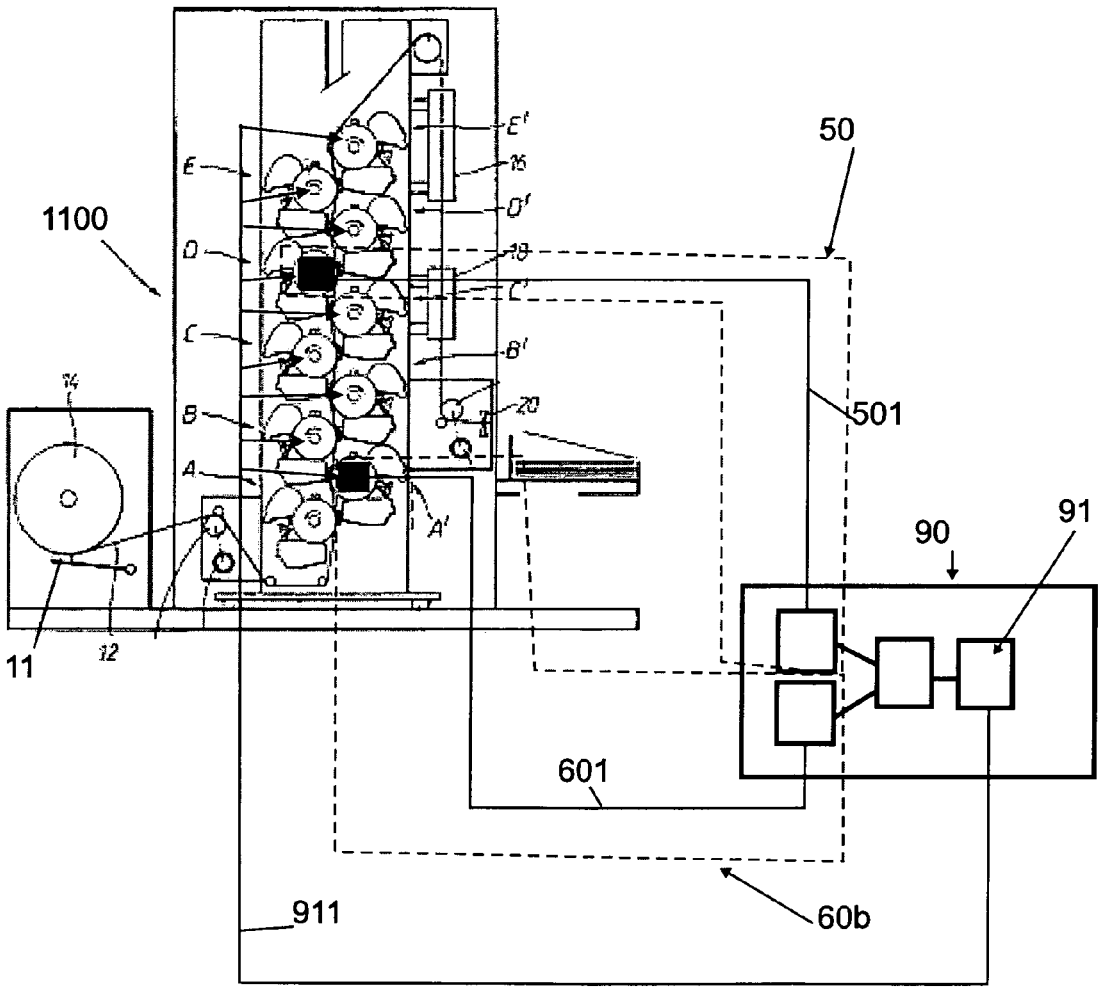
FIG. 6 is a schematic representation of a side (planar) view of the apparatus according to a fourth embodiment of the present invention, showing an alternative double side electrostatographic single-pass multiple station printer.

FIG. 6 shows a schematic representation of a side (planar) view of a printing apparatus 1100 according to a fourth embodiment of the present invention, showing a double side electrostatographic single-pass multiple station printer. The printer 1100 is, in some aspects, similar to the printer 100 as shown in FIG. 2 and corresponding numerical references refer to identical or analogous means. The printer comprises two sets of five printing stations (A, B, C, D and E, and A', B', C', D' and E' respectively), each set being provided at a particular side of the printing medium 12. The printing medium advancement measurement means 60*b*, e.g. longitudinal printing medium displacement or velocity measurement device, is now coupled to a printing station A', contacting the printing medium 12 at the opposite side as the one which is contacted by the printing station D, to which the main encoder means 50 is coupled. The printing medium advancement measurement means 60*b* generates a similar signal 601 which set of pulses 601 is relative to the printing medium displacement at printing station A'. The skilled man understands that the functioning of this embodiment is analogous to the functioning of the printer 100 of FIG. 2.

It was found that the adjustment of the pulses 501 by using pulses of a second encoder means according to the present invention is most efficient in case it is used for printers of which the printing medium is the final printing medium. This is especially the case for duplex or double side printers, printing directly on both sides of a final printing medium.

The invention claimed is:

1. An electrostatographic single-pass multiple station printer for forming an image onto a printing medium, which comprises:

(i) a plurality of toner image-printing electrostatographic stations comprising (ia) rotatable endless surface means onto which a toner image can be formed;

(ib) means for forming an electrostatic toner image on each said surface means; and (ic) means for transferring the formed toner image onto a printing medium;

(ii) means for conveying a printing medium in succession past said stations in synchronism with the peripheral speed of said rotatable endless surface means; and (iii) register control means for controlling the operation of each of said stations in timed relationship thereby to obtain correct registering of the distinct toner images on the printing medium, wherein said register control means comprises (iiia) a main encoder means for producing a first signal indicative of printing medium displacement at a first position, and (iiib) delay means for initiating the operation of subsequent image-printing stations after a predetermined printing medium displacement, as measured by the main encoder means, has occurred, wherein said register control means comprises a further printing medium advancement measurement means comprising a second encoder means for producing a second signal representative of printing medium displacement at a second position, said printing medium advancement measurement means being adapted to cooperate with said main encoder means for automatic adjustment of said first signal using said second signal.

2. An electrostatographic single-pass multiple station printer as in claim 1, wherein the adjusted first signal is provided to the delay means.

3. An electrostatographic single-pass multiple station printer as in claim 1, wherein said main encoder means is mechanically coupled to a rotatable endless surface means onto which a toner image can be formed.

4. An electrostatographic single-pass multiple station printer as in claim 1, wherein said printing medium advancement measurement means is coupled to said main encoder means by means of a comparator for obtaining the difference between said second signal and said first signal indicative of printing medium displacement, said difference being used to automatically adjust said first signal indicative of printing medium displacement.

5. An electrostatographic single-pass multiple station printer as in claim 1, wherein said second encoder means is mechanically coupled to the rotatable endless surface means onto which a toner image can be formed.

6. An electrostatographic single-pass multiple station printer as in claim 5, wherein said rotatable endless surface means onto which a toner image can be formed is the rotatable endless surface means of the toner image-printing electrostatographic station first passed by the printing medium.

7. An electrostatographic single-pass multiple station printer as in claim 1, wherein said second encoder means is mechanically coupled to a reverse roll.

8. An electrostatographic single-pass multiple station printer as in claim 1, wherein said main encoder means is located downstream of said printing medium advancement measurement means.

9. An electrostatographic single-pass multiple station printer as in claim 1, wherein said main encoder means is mechanically coupled to the rotatable endless surface means onto which a toner image can be formed of an intermediately positioned toner image-printing electrostatographic station.

10. An electrostatographic single-pass multiple station printer as in claim 1, wherein said printing medium advancement measurement means includes measurement means for measuring any of longitudinal printing medium displacement, absolute position of the printing medium, printing medium velocity, printing medium acceleration or a combination of any of these.

11. An electrostatographic single-pass multiple station printer as in claim 1, wherein said printer further comprises means for transferring the image formed on the printing medium onto a final printing medium.

12. An electrostatographic single-pass multiple station printer as in claim 1, wherein said printing medium is a final printing medium.

13. An electrostatographic single-pass multiple station printer as in claim 1, wherein said printing medium is provided by unwinding the printing medium from a roll.

14. An electrostatographic single-pass multiple station printer as in claim 1, wherein said printer is a double side printer.

15. An electrostatographic single-pass multiple station printer as in claim 14, wherein said printing medium is a final printing medium.

16. An electrostatographic single-pass multiple station printer as in claim 1, wherein said stations are line array exposure based printing stations.

17. An electrostatographic single-pass multiple station printer as in claim 15, wherein said stations are line array exposure based printing stations.

18. A method of operating an electrostatographic single-pass multiple station printer for forming an image onto a printing medium, the printer comprising:

(i) a plurality of toner image-printing electrostatographic stations comprising (ia) rotatable endless surface means onto which a toner image can be formed;

(ib) means for forming an electrostatic toner image on each said surface means; and (ic) means for transferring the formed toner image onto the printing medium;

(ii) means for conveying the printing medium in succession past said stations in synchronism with the peripheral speed of said rotatable endless surface means; the method comprising controlling the operation of each of said stations in timed relationship thereby to obtain correct registering of the distinct toner images on the printing medium, the controlling comprising:

deriving a first signal indicative of printing medium displacement at a first position using a main encoder for measuring printing medium displacement at the first position, and delaying the operation of subsequent image-printing stations after a predetermined printing medium displacement, deriving a second signal representative of the printing medium displacement at a second position using a second encoder to obtain a measurement performed on said printing medium, and adjusting said first signal using said second signal; wherein the adjusted first signal is used for delaying the operation of subsequent image-printing stations.

* * * * *